US006158631A

United States Patent [19]

Varini

[11] Patent Number: 6,158,631

[45] Date of Patent: Dec. 12, 2000

[54] POSITIONABLE-SPOUT FLUID-DISPENSER GUN

[75] Inventor: Otto Varini, Suzzara, Italy

[73] Assignee: PIUSI S.p.A., Suzzara, Italy

[21] Appl. No.: 09/217,569

[22] Filed: Dec. 21, 1998

[30] Foreign Application Priority Data

Jan. 19, 1998 [IT] Italy ..... MO98A0008

[51] Int. Cl.[7] ..... B67D 5/00

[52] U.S. Cl. ..... 222/536; 222/79; 222/526; 222/529; 222/571

[58] Field of Search ..... 222/78, 79, 526, 222/527, 529, 533, 536, 537, 566, 567, 570, 571; 141/382, 392

[56] References Cited

U.S. PATENT DOCUMENTS

| | | | |
|---|---|---|---|
| 2,223,854 | 12/1940 | Peaster | 222/529 |
| 2,888,172 | 5/1959 | O'Brian | 222/79 |
| 3,905,524 | 9/1975 | Tatsuno | 222/536 |
| 4,035,004 | 7/1977 | Hengesbach | 222/536 |
| 4,062,480 | 12/1977 | Bjorklund | 222/571 |
| 4,526,298 | 7/1985 | Boxer et al. | 222/529 |
| 4,803,974 | 2/1989 | Powell | 222/79 |
| 4,972,972 | 11/1990 | Goguen | 222/529 |
| 5,318,202 | 6/1994 | D'Andrade | 222/78 |

*Primary Examiner*—J. Casimer Jacyna
*Attorney, Agent, or Firm*—Browdy and Neimark

[57] ABSTRACT

A gun for dispensing fluids having a positionable spout comprises a handle provide with a trigger which is posteriorly coupled, by means of a rotatable connection, to a flexible fluid feed pipe and which anteriorly bears a spout destined to be introduced into an access of a container to be filled with fluid. The spout is sealedly connected to the handle by means of a connection which is rotatable about an axis of rotation which is not parallel to an axis of the handle.

8 Claims, 2 Drawing Sheets

III
9
4
5
11
x
x
7
10
9
8
3
30
6
31
III
11
4
5
x
x
7
10

30
3
61
60
6
31

POSITIONABLE-SPOUT FLUID-DISPENSER GUN

BACKGROUND OF THE INVENTION

In particular, though not exclusively, the positionable-spout fluid-dispenser gun can be usefully employed in car maintenance workshops where centralized systems are used for storing and distributing lubricating oils and other fluids. These plants are generally constituted by oil tanks having pumps which feed the oils to flexible pipes provided with dispenser guns. The guns can be equipped with dispensing rate instruments enabling them to operate automatically to deliver a pre-set fluid delivery quantity.

Whether automatic or not, all of the guns of the above type can be fitted with numerous types of dispenser spouts so that the fluids can be delivered to all necessary points on a car, often situated in difficult places, with awkward operator access, and in any case different from car to car. In particular, the need to equip the gun with the right spout for the right car is due to the multifarious nature of oil filler access mouths on different cars; the operator needs to be able to see and control the flow and quantity of oil, so a proper-fitting spout and a gun which can be easily and advantageously positioned is extremely useful.

The above requirements have led to the providing of various spouts, for example spouts which can be aligned more or less perfectly with the gun barrel, as well as spouts mountable practically perpendicular to the gun grip. There are also spouts which exhibit a central part normally constituted by a tract of flexible piping affording favorable positioning of the pistol with respect to the end of the spout inserted into the fluid filler point. Here too, however, the flexibility of the spout alone is not enough to satisfy the whole range of requirements and exigencies which crop up day-to-day—the workshop still has to invest in a range of dedicated spouts for the gun. All of the above constitutes a severe limitation in the prior art applications, which means that for each type of vehicle a manual intervention on the dispenser gun is needed in order to mount the correct spout. This inevitably and obviously means more time lost in removing the previously-mounted spout, not to mention the spilling of fluid this leads to.

SUMMARY OF THE INVENTION

The main aim of the present invention is to obviate the drawbacks inherent in the prior art, but providing a single universal and positionable spout which can achieve a wide range of desired configurations.

An advantage of the invention is its constructional and operational simplicity. The above aims and others besides are all attained by the present invention, as it is characterized in the appended claims.

BRIEF DESCRIPTION OF THE DRAWINGS

Further characteristics and advantages of the present invention will better emerge from the detailed description that follows, of a preferred but non-exclusive embodiment thereof, here described in the form of a non-exclusive embodiment, illustrated in the figures, in which.

DESCRIPTION OF THE PREFERRED EMBODIMENTS

Figure 1:
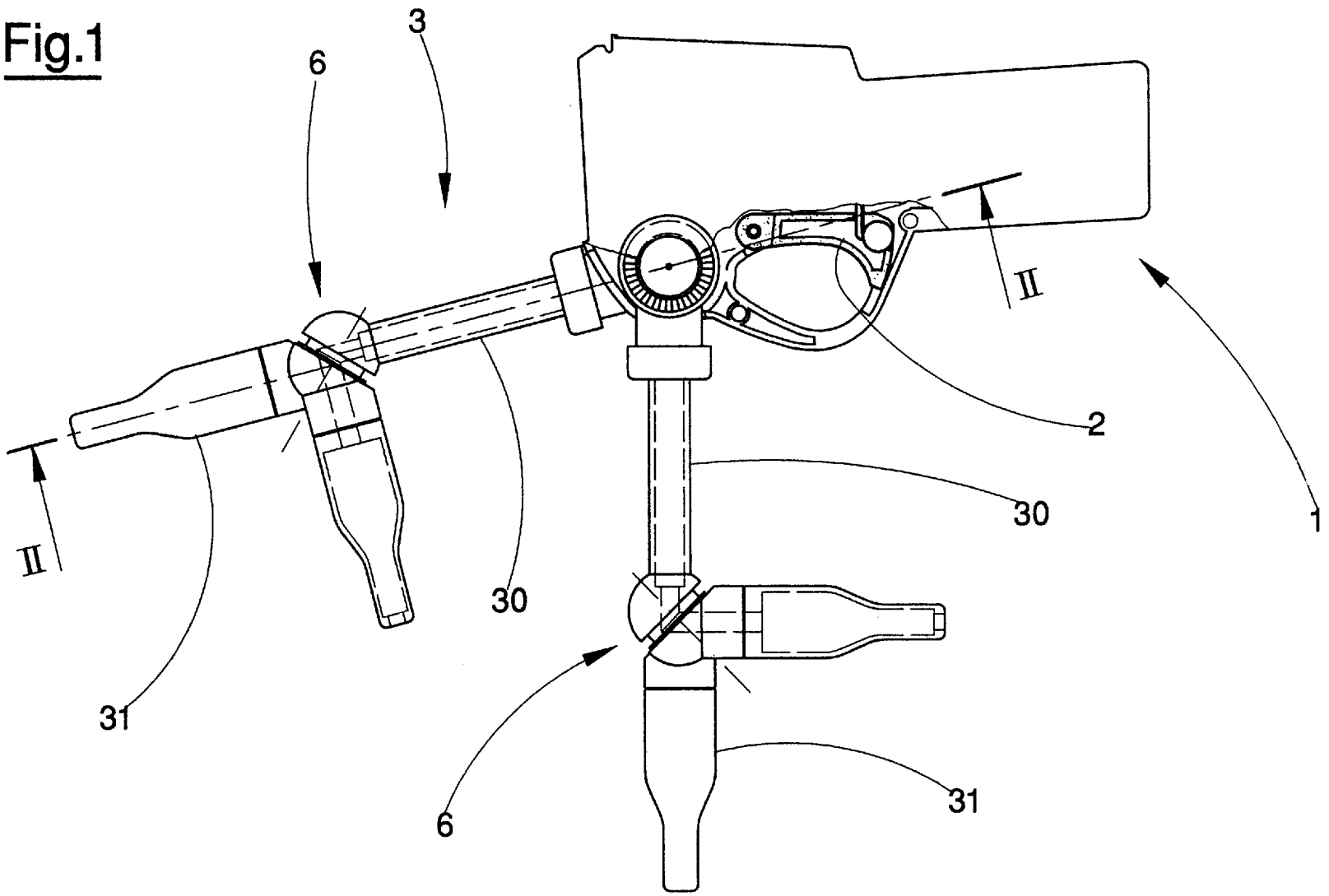
FIG. 1 is a schematic side view.
Figures 2, 3, 4:
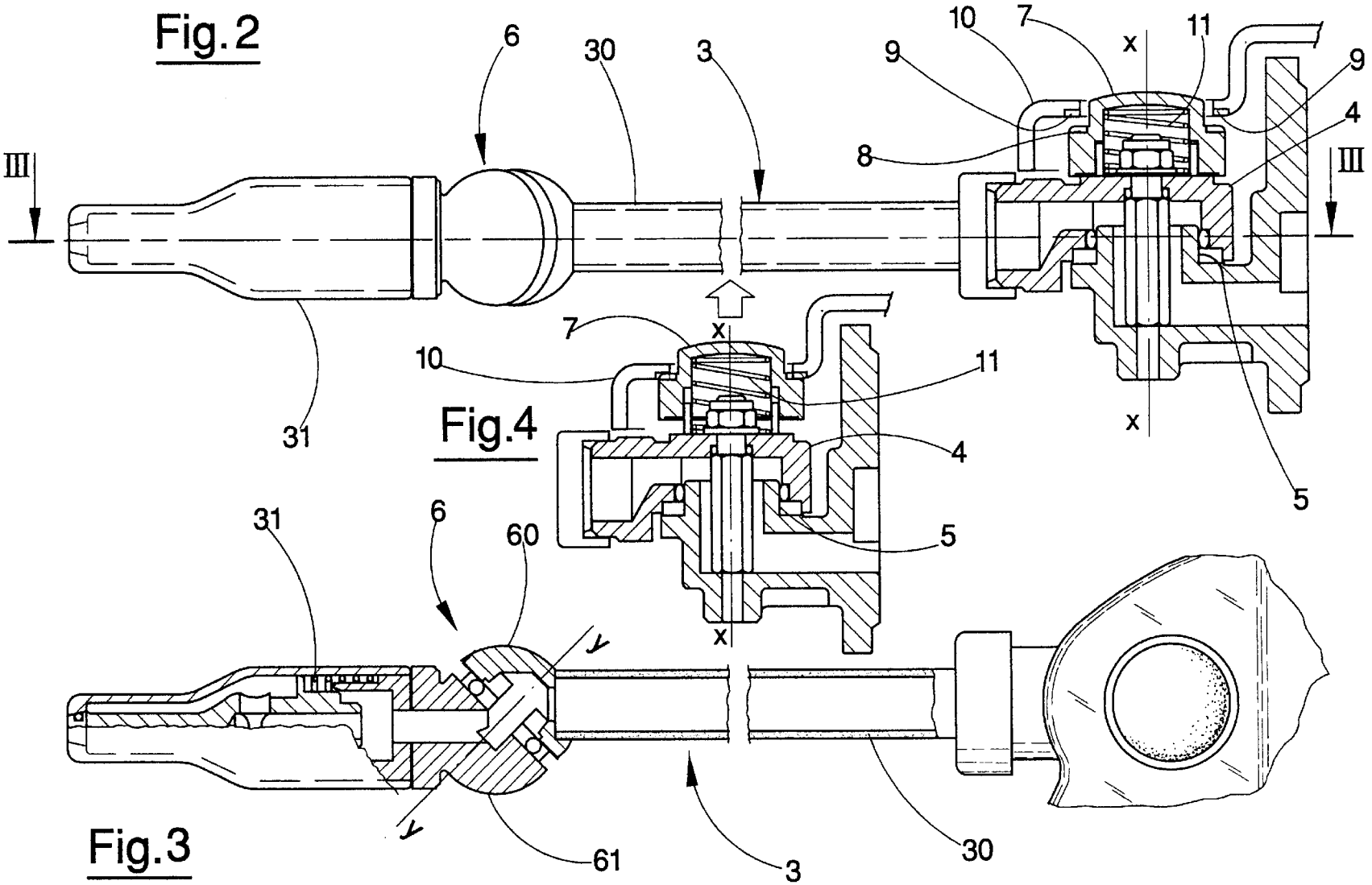
FIG. 2 is part of a schematic section made according to line II—II of FIG. 1.
FIG. 3 is a partially-sectioned schematic view according to line III—III of FIG. 2.
FIG. 4 is a detail of FIG. 2, in a different operational configuration.

With reference to the figures of the drawings, 1 denotes in its entirety the handle 1 of a fluid-dispenser gun, in particular for lubricating oils and other fluids used typically in a workshop.

The handle 1 is connected posteriorly by means of a rotatable coupling to the flexible feed pipe, and is provided with a trigger 2 for commanding fluid delivery. The trigger 2 acts directly on a valve, not shown, which, when the trigger 2 is released, interrupts fluid passage.

A pre-setting and metering device for automatic gun operation can be associated to the handle 1.

A spout 3 is arranged anteriorly of the handle 1. This spout 3 is basically a tubular element, normally provided with an anti-drip valve, destined to be inserted into the filler sleeve or mouth of a sump or other container to be filled. The spout 3 is sealedly connected to the handle 1 by means of a connection 4, rotatable about an axis x—x which is not parallel to the handle 1 axis. In the illustrated example the rotation axis is substantially perpendicular to the plane of mobility of the trigger 2.

The rotatable connection 4 is sealedly coupled on an annular seat 5, located at an end of a conduit, and can be locked on command in any of a plurality of different positions in relation thereto.

A button 7 is provided, arranged coaxially to the rotation axis x—x, which button is axially mobile and is forced towards a wall of an external housing 10 of the button 7 by a spring 11.

The button 7 is peripherally provided with teeth 8 dimensioned so as to insert with predetermined play in seatings 9 afforded peripherally along an edge of the aperture afforded in the housing 10 for the top of the button 7 to emerge. The button 7 is coupled to the connection 4 by a coupling which allows only translations along axis x—x.

Thus, when the button 7 is pressed so as to release the teeth 8 from the seatings 9, the connection can be freely rotated and the spout 3 can be positioned as desired.

The release of the button 7 enables the teeth 8 to engage in the corresponding seatings 9 so as to block any rotation with respect to the housing 10 of the button 7, and therefore the connection 4 which is solid in rotation with the button 7. In this way the intermediate portion 30 of the spout 3, which originates in the connection 4, is blocked in the desired position with respect to the handle 1 of the gun.

The intermediate portion 30 of the spout 3, which originates in the connection 4, is substantially constituted by a straight tract of piping which terminates in a joint 6. The joint 6 sealingly connects the intermediate portion 30 with a shorter terminal portion 31 comprising an anti-drip valve.

The joint 6 is basically constituted by two parts 60 and 61 which are solidly connected both with the intermediate portion 30 and the terminal portion 31 of the spout 3.

The two parts 60 and 61 are constrained one to the other rotatably about an axis y—y which is perpendicular to the plane of separation between the two parts. Axis y—y is inclined (in the example by about 45°) with respect to the axis of the intermediate portion 30.

Axis y—y, about which the two parts 60 and 61 are relatively rotatable, is incident both to the axis of the intermediate portion 30 and to the axis of the terminal portion 31. In the illustrated embodiment the rotation axis y—y forms an angle of approximately 45° with the axis of the terminal portion 31 (as with the intermediate portion 30).

The sealed couple between the two parts 60 and 61 means that they can be rotated one about another in such a way as to assume any desired reciprocal positioning.

The geometrical arrangement of the axes of the intermediate portion 30 and the terminal portion 31 with respect to the relative rotation of the two parts 60 and 61 means that the two parts 60 and 61 can be positioned so that the terminal portion 31 is practically aligned with the intermediate portion 30; it is also possible to position the two parts 60 and 61 so that the axis of the terminal portion 31 forms any desired angle with the axis of the intermediate portion 30, including a right angle.

It is therefore possible to achieve any angling of the terminal portion 31 with respect to the intermediate portion 30.

By pressing the button 7 to disengage the teeth 8 from the seatings 9 in the housing 10, the connection 4 is freed, and consequently the whole intermediate portion 30 can be rotated about axis x—x. This means that the intermediate portion 30 can be positioned at the desired inclination with respect to the handle 1.

The spout 3 can thus be configured as required for any operation. A considerable advantage of the invention consists in its extreme ease of use. A further advantage consists in the rapidity with which the configuration of the spout can be varied to adapt it to a single specific need.

What is claimed:

1. A fluid-dispenser gun with a positionable-spout, comprising:

a handle provided with a trigger which handle is adapted to be posteriorly coupled to a flexible fluid delivery pipe, and which handle anteriorly bears a spout destined to the introduced into an access of a container to be filled, wherein the spout is sealedly connected to the handle by a connection having a rotation axis which is not parallel to an axis of the handle, and wherein the connection having a rotation axis is sealedly coupled on an annular seat located at an end of a conduit, and is lockable in relation to the annular seat in any of a plurality of positions.

2. The gun of claim 1, wherein the rotation axis about which the connection is mobile is perpendicular to a plane in which the trigger is mobile.

3. The gun of claim 1, wherein a straight intermediate portion of the spout originates in said connection and terminates in a joint which joint sealedly connects the intermediate portion with a terminal portion of the spout.

4. The gun of claim 3, wherein the terminal portion of the spout comprises an anti-drip valve.

5. The gun of claim 3, wherein the joint comprises two parts which are sealedly constrained one to another along an inclined plane having a predetermined angle of inclination with respect to an axis of the intermediate portion.

6. The gun of claim 5, wherein an axis of relative rotation of the two parts is incident both with the axis of the intermediate portion and with an axis of the terminal portion.

7. The gun of claim 6, wherein the axis of relative rotation of the two parts and the axis of the intermediate portion form an angle of about 45°.

8. The gun of claim 7, wherein the axis of relative rotation of the two parts and the axis of the terminal portion, comprising the anti-drip valve, form an angle of about 45°.

* * * * *